US007900360B2

(12) United States Patent
Pretlove et al.

(10) Patent No.: US 7,900,360 B2
(45) Date of Patent: Mar. 8, 2011

(54) CUTTER ASSEMBLY AND METHOD OF PRODUCING SAME

(75) Inventors: Richard John Pretlove, Reading (GB); Trevor John Crichton, Chesham (GB)

(73) Assignee: The Gillete Company, Boston, MA (US)

( * ) Notice: Subject to any disclaimer, the term of this patent is extended or adjusted under 35 U.S.C. 154(b) by 439 days.

(21) Appl. No.: 11/658,300

(22) PCT Filed: Jul. 21, 2005

(86) PCT No.: PCT/US2005/025873

§ 371 (c)(1),
(2), (4) Date: Sep. 4, 2008

(87) PCT Pub. No.: WO2006/012412

PCT Pub. Date: Feb. 2, 2006

(65) Prior Publication Data

US 2009/0211103 A1 Aug. 27, 2009

(30) Foreign Application Priority Data

Jul. 23, 2004 (GB) ..... 0416534.6

(51) Int. Cl.
*B26B 19/00* (2006.01)

(52) U.S. Cl. ..... 30/43.92; 30/346.51

(58) Field of Classification Search ..... 30/43.92, 30/346.51, 43.4; 76/104.1
See application file for complete search history.

(56) References Cited

U.S. PATENT DOCUMENTS

| | | | | | |
|---|---|---|---|---|---|
| 1,356,628 | A | * | 10/1920 | Johanson | 76/104.1 |
| 2,037,957 | A | * | 4/1936 | Andis | 30/221 |
| 2,098,849 | A | * | 11/1937 | Amsler | 30/43.2 |
| 2,161,981 | A | * | 6/1939 | Ruskin | 30/41.5 |
| 2,168,406 | A | * | 8/1939 | Harris | 72/341 |
| 2,184,180 | A | * | 12/1939 | Fairey | 30/43.6 |
| 2,216,994 | A | * | 10/1940 | Wall et al. | 30/41.6 |
| 2,281,250 | A | * | 4/1942 | Ruskin | 76/104.1 |
| 2,290,689 | A | * | 7/1942 | Law | 30/41.6 |
| 2,292,858 | A | * | 8/1942 | Alexay | 30/34.1 |
| 2,307,471 | A | * | 1/1943 | Schaffer et al. | 30/43.92 |
| 2,331,274 | A | * | 10/1943 | Martin | 30/43.92 |
| 2,411,594 | A | * | 11/1946 | Ruskin | 30/346.51 |
| 2,900,719 | A | * | 8/1959 | Kohner et al. | 30/43.92 |
| 3,924,581 | A | | 12/1975 | Jones | |
| 3,927,581 | A | * | 12/1975 | Kolodziej | 76/104.1 |
| 5,197,196 | A | | 3/1993 | Imagawa et al. | |
| 6,560,875 | B1 | | 5/2003 | Eichhorn et al. | |
| 2002/0083592 | A1 | * | 7/2002 | Liao | 30/43.92 |
| 2005/0198827 | A1 | * | 9/2005 | Andrew et al. | 30/43.6 |

FOREIGN PATENT DOCUMENTS

| | | | | |
|---|---|---|---|---|
| BE | 805902 | A | * | 4/1974 |
| EP | 69468 | A1 | * | 1/1983 |
| GB | 2 038 691 | A | | 7/1980 |

* cited by examiner

*Primary Examiner* — Jason Daniel Prone
*Assistant Examiner* — Jennifer Swinney
(74) *Attorney, Agent, or Firm* — Jay A. Krebs; Kevin C. Johnson

(57) ABSTRACT

A cutter assembly for a dry shaver, comprising an elongate carrier member (221); and a cutter element (1210) having a plurality of turns forming a helix, each having an arcuate cutting portion (1211) and an arcuate mounting portion following sequentially along the helix; said carrier member being disposed substantially parallel to the axis (D-D) of said cutter element; and said carrier member contacting and supporting the mounting portions of the turns and leaving the cutting portions as free-span arches.

18 Claims, 7 Drawing Sheets

*Prior Art*

Prior Art

Figure 1:
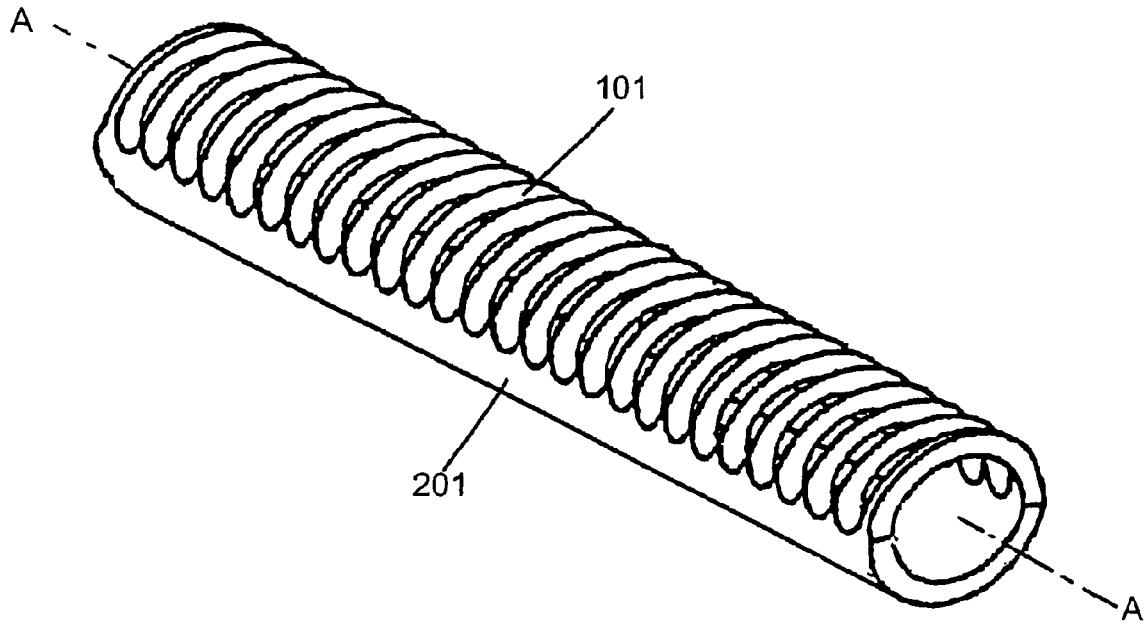

Fig. 6a
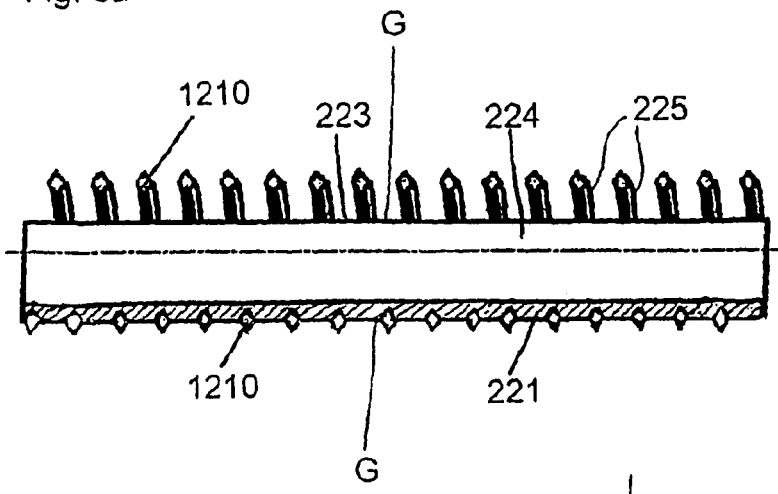
Fig. 6b
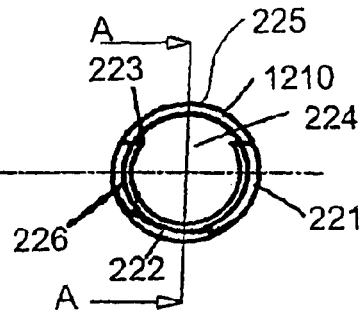
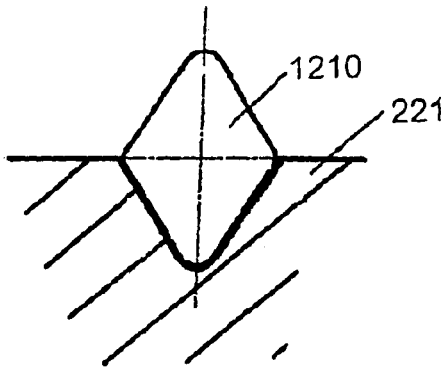
Fig. 6c
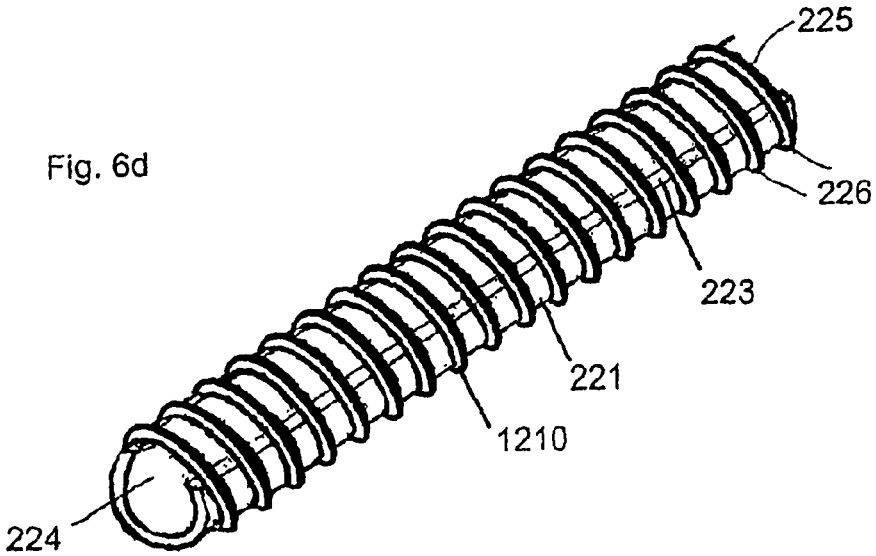
Fig. 6d

Fig. 7a
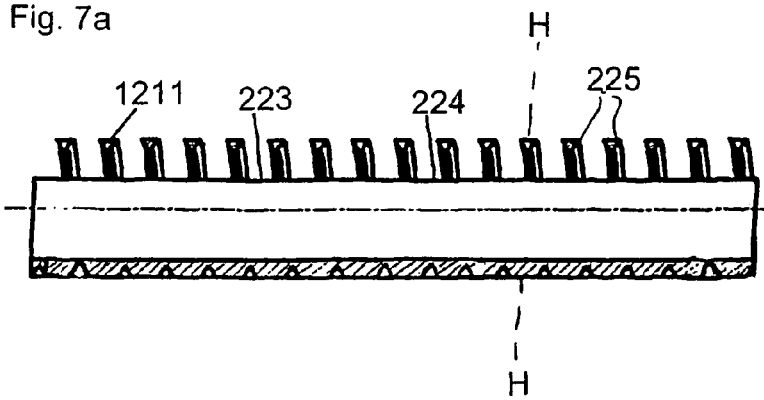
Fig. 7b
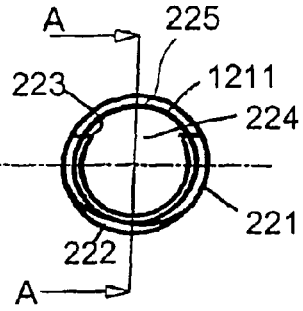
Fig. 7c
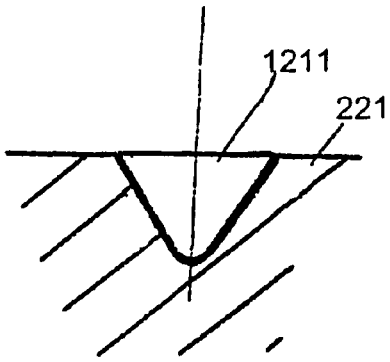
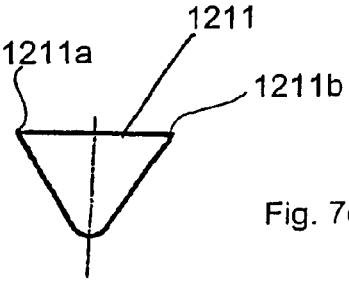
Fig. 7d
Fig. 7e
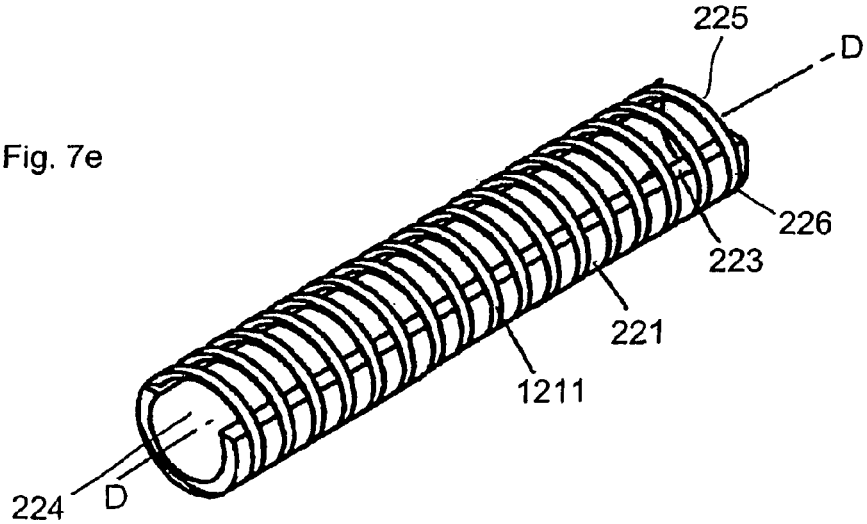

CUTTER ASSEMBLY AND METHOD OF PRODUCING SAME

The present invention relates to a cutter assembly for powered shaving apparatus, and to methods of manufacturing such an assembly.

Traditionally, shaving devices have been divided into wet shavers and dry shavers. Wet shavers generally involve one or more razor-sharp blades to be dragged across the surface to be shaved along a line at right angles to the edges of the blades themselves, in the presence of a lubricating foam or fluid. Dry shavers on the other hand generally comprise a large number of cutting elements that are moved by an actuation mechanism, often an electric motor, at high speed relative to the surface to be shaved, in either a circular or linear reciprocating motion. Dry shavers of this kind are complex and costly, and can approach the shaving performance of wet shavers only with difficulty.

Various assemblies intended to be reciprocated along an axis at right angles to the shaving direction, and comprising a plurality of cutting edges extending substantially parallel to the shaving direction, are known in the prior art. U.S. Pat. No. 6,560,875, for example, discloses a cutter assembly for a dry shaver provided with a plurality of arcuate cutter elements, mounted on a carrier. The arcuate cutters are arranged parallel to one another along the length of the carrier. Gaps are provided between every adjacent pair of cutters, into which gaps hairs may protrude during use, so that by means of an oscillatory motion the hairs may be cut. This assembly is machined from a single block of metal, which leads to a high manufacturing cost. Furthermore, the cutting edges of the cutters cannot easily be varied from 90°, without a still further increase in the manufacturing costs, such that effective cutting is difficult to achieve.

Similarly, U.S. Pat. No. 2,281,250 discloses an alternative cutting assembly for a dry shaver. In this arrangement, there is provided a cylindrical carrier, on the outer surface of which is provided a helical thread, protruding from the surface of the carrier. In this apparatus, there is further provided a helical cutting strip which is wound about the carrier to rest upon the thread, so that the helices of the thread and the cutting strip are aligned with each other. The cutting thread is provided with an acute cutting edge, so as to offer improved cutting performance. In use, this device is oscillated back and forth so that the cutting edge of the cutting strip engages hairs introduced into the gap between separate loops of the cutting strip. This arrangement entails considerable expense in its manufacture, due to the difficulty of producing a helical cutting strip, and satisfactorily fixing this to the carrier. It is in particular to be noted that a linear cutting strip cannot be wound into a helical shape without distortion.

U.S. Pat. No. 2,307,471 discloses a method of producing a cutting element for a dry shaver in which a cylindrical metal tube having an eccentric bore is tapped internally to form a thread on its inner surface. The depth of this internal thread is such that the thinner part of the tube wall is penetrated, to as to form sharp edged gaps through which hairs may pass to be sheared.

All of these prior art assemblies represent imperfect compromises between the various considerations important in the design of such cutter assemblies such as cutting effectiveness, comfort and cost of manufacture.

It is desirable to arrive at a cutting element for use in an actuated system that offers good cutting performance, is inexpensive to manufacture and is suitable for use both in the presence of a lubricating foam or fluid and without such foam or fluid.

According to the invention from a first aspect, there is provided a cutter assembly for a dry shaver, comprising an elongate carrier member, and a cutter element having a plurality of turns forming a helix, each having an arcuate cutting portion and an arcuate mounting portion following sequentially along the helix. The carrier member is disposed substantially parallel to the axis of said cutter element, and contacts and supports the mounting portions of the turns and leaving the cutting portions as free-span arches.

According to a development of this first aspect, the carrier member is disposed within the cutter element.

According to a further development of this first aspect, the carrier member has a substantially "c" or "u" shaped cross-section.

According to a still further development of this first aspect, the cutting portions each provide a pair of opposed acute-angled cutting edges.

According to a still further development of this first aspect, the turns of the cutter element are triangular in cross-section.

According to a still further development of this first aspect, the apex of the triangular cross-section of the cutter element is on the inside of the helix formed thereby.

According to a still further development of this first aspect, the carrier member is provided with a thread to receive the mounting portions of said cutter element.

According to the invention from a second aspect, there is provided a method of producing a cutter assembly for a dry shaver, comprising the steps of producing an elongate carrier member, producing a cutter element having a plurality of turns forming a helix, each having an arcuate cutting portion and an arcuate mounting portion following sequentially along the helix, and securing the mounting portions of each of said plurality of turns to the carrier member so that the carrier member contacts and supports the mounting portions of the turns and leaves the cutting portions as free-span arches.

According to a development of this second aspect, carrier member is formed by removing material from one side of a circular-cylindrical body.

According to a further development of this second aspect, a flat is machined on one side of said body.

According to a still further development of this second aspect, the method may comprise the further steps of drilling a cavity of a first radius axially of the body having a second radius and wherein in machining said flat the cross-sectional thickness of said body perpendicular said flat is reduced by an amount greater than the difference between said first radius and said second radius.

According to a still further development of this second aspect, the method may comprise the further steps of machining a helical thread into the surface of said body for receiving the helical cutter element.

According to a still further development of this second aspect, the helical cutter element initially has a rhombic cross-section and is reduced to a triangular cross-section by machining.

According to a third aspect of the invention, there is provided a method of producing a cutter for a dry shaver comprising the steps of providing a helical element having a cross section such that by machining an external surface thereof a sharp edge is formed on at least one edge thereof, fixing the helical element around an elongate support, and removing the external surface of the helical element so as to form said sharp edge on at least one edge thereof.

According to a development of this third aspect, a helical element is fixed around a cylindrical body.

According to a further development of this third aspect, the method may comprise the further steps of, forming a cavity of a first radius axially of the cylindrical body of second radius, and forming a flat on one side of the cylindrical body, so that the cross-sectional thickness of the cylindrical body perpendicular the flat is reduced by an amount greater than the difference between the first radius and the second radius.

According to a still further development of this third aspect, the method may comprise the further step of, prior to the step of fixing a helical element around said cylindrical body, forming a helical thread into the body, of such dimensions as to receive the helical element.

According to a still further development of this third aspect, at the step of removing an external surface of said helical element, sharp edges are produced on both helical edges thereof.

According to the present invention from a fourth aspect, there is a provided a method of producing a cutter for a dry shaver, comprising the steps of providing a helical element having an inner diameter having a first dimension, forming arcuate cutting portions on successive turns of said helical element, providing an elongate carrier member having a thickness, as seen in a direction transverse to its longitudinal extent, of a second dimension, said second dimension being less than said first dimension of the helical element, contacting the helical element with a lower surface of the carrier member, and extending the arcuate cutting portions transversely across the carrier member in spaced relation thereabove.

Figure 2A:
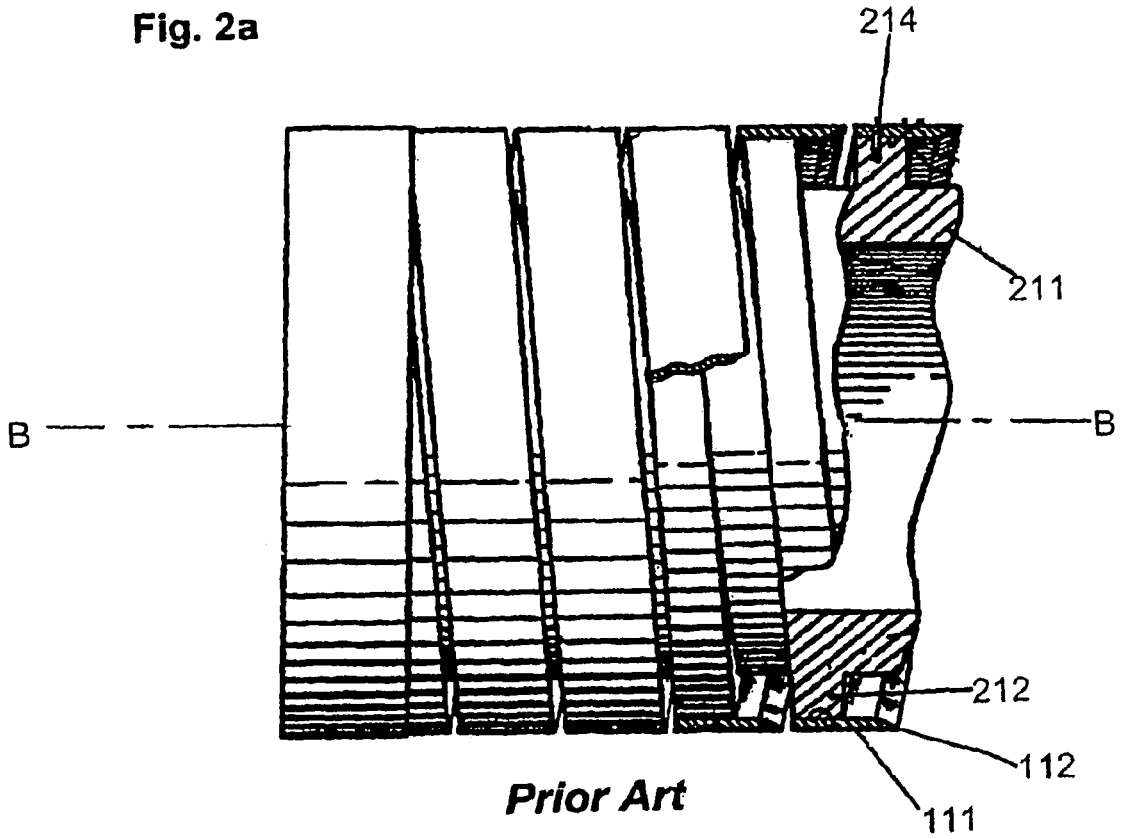
Figure 2B:
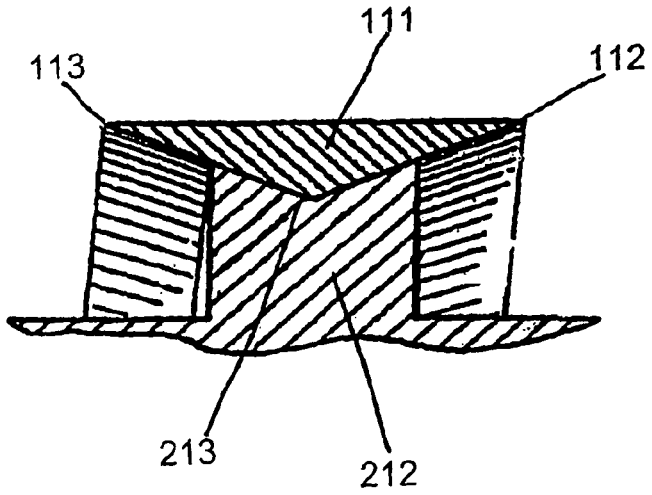
Prior Art Fig. 2b

For a better understanding of the invention, and to show how the same may be carried into effect, reference will now be made, by way of example, to the accompanying drawings, in which:

FIG. 1 shows a first cutter assembly for a dry shaver as known from prior art document U.S. Pat. No. 6,560,875;

FIG. 2*a* shows a cutting assembly for a dry shaver as known from a second prior art document U.S. Pat. No. 2,281,250;

FIG. 2*b* shows a development of the assembly of FIG. 2*a;*

Figure 3A:
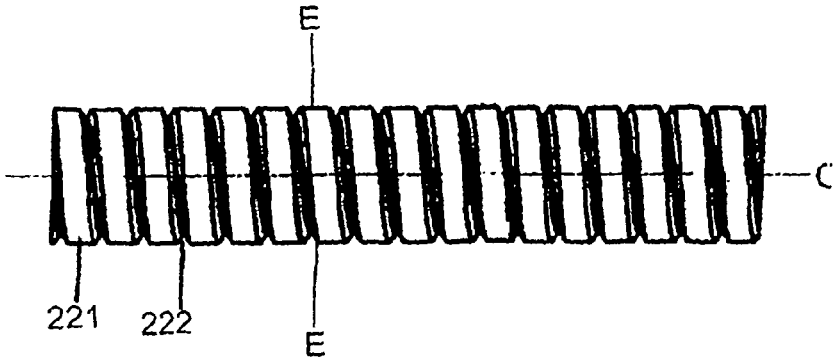
Figure 3B:
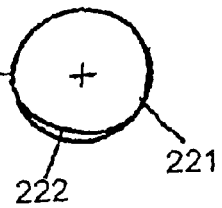

FIG. 3*a* shows the first and second steps of the method of manufacture according to this embodiment of the invention in a side view;

FIG. 3*b* shows a section of E-E of the support member shown in FIG. 3*a;*

Figure 3C:
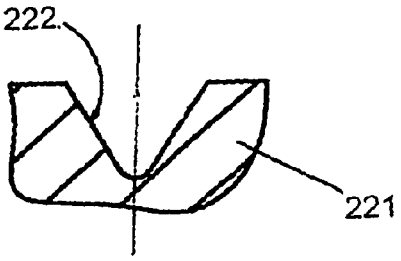

FIG. 3*c* shows a partial cross-section of the carrier member as formed by the threading process described with regard to FIG. 3*a;*

Figure 4A:
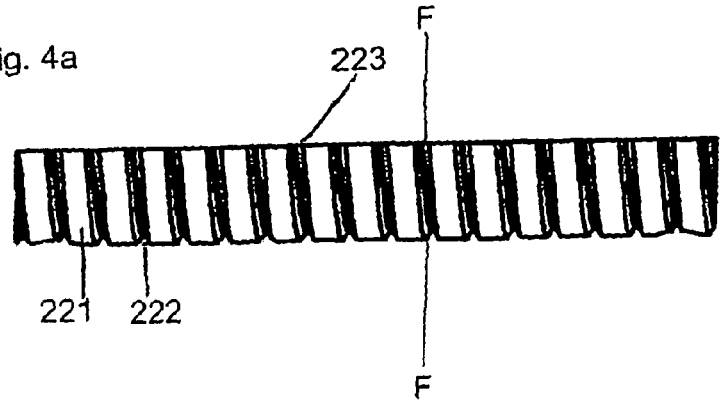
Figure 4B:
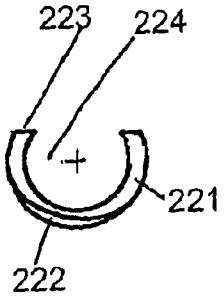

FIG. 4*a* shows the third step of the method according to this embodiment of the present invention in a side view;

FIG. 4*b* shows a section F-F of the support member shown in FIG. 4*a;*

Figure 5A:
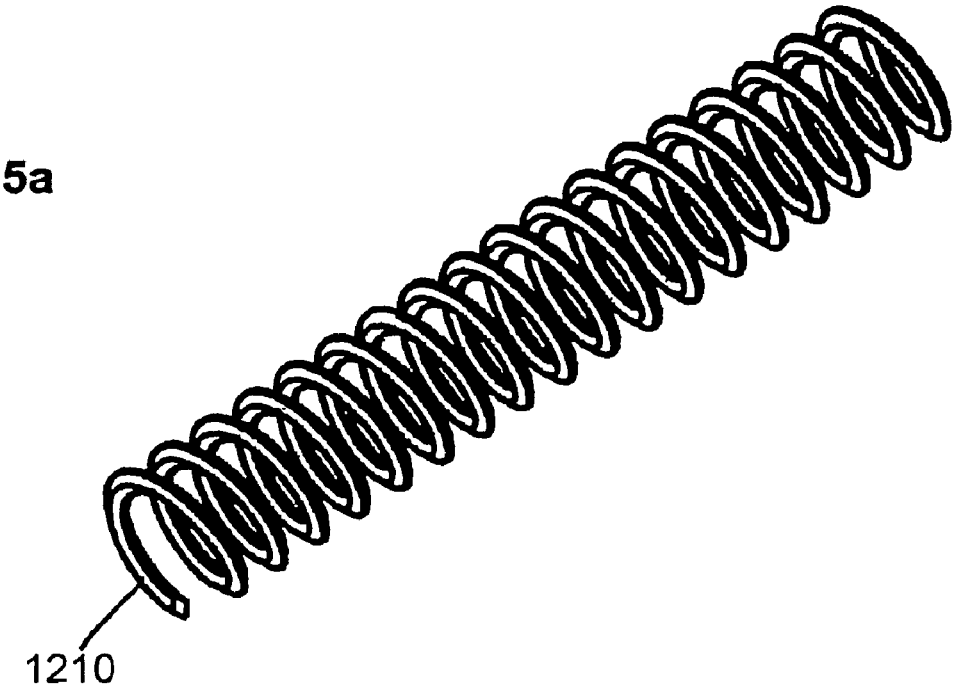
Figure 5B:
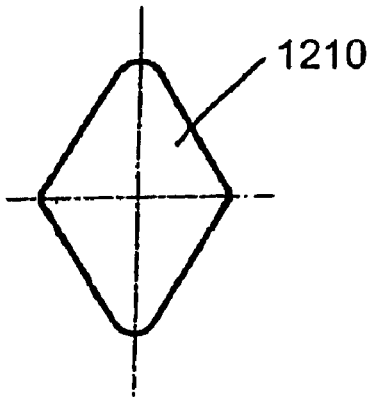

FIGS. 5*a* & 5*b* show a helical structure used as a component of the cutting assembly according to an embodiment of the present invention;

FIG. 6*a* shows a fourth step in a method according to an embodiment of the present invention in a side view;

FIG. 6*b* shows a section G-G through the carrier member and helical element shown in FIG. 6*a;*

FIG. 6*c* shows a cross-section of the helical element, as in position, threaded into the carrier member;

FIG. 6*d* shows an isometric projection of the assembly shown in FIG. 6*a;*

FIG. 7*a* shows the cutter assembly after the execution of a fifth step according to this embodiment of the present invention in a side view;

FIG. 7*b* shows a section H-H through the carrier member and helical elements shown in FIG. 7*a;*

Figure 8A:
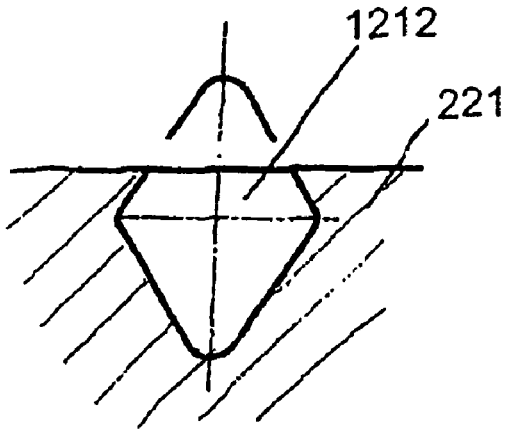
Figure 8B:
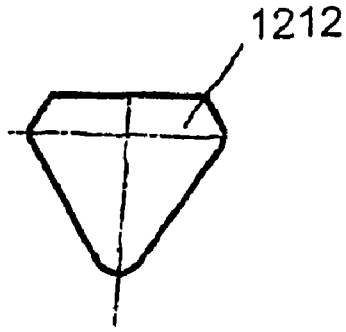
Figure 8C:
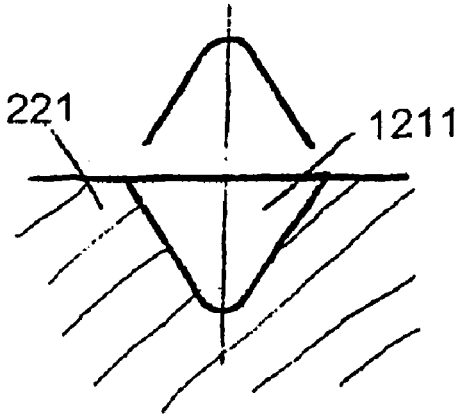
Figure 8D:
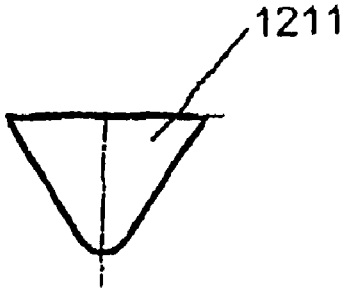
Figure 8E:
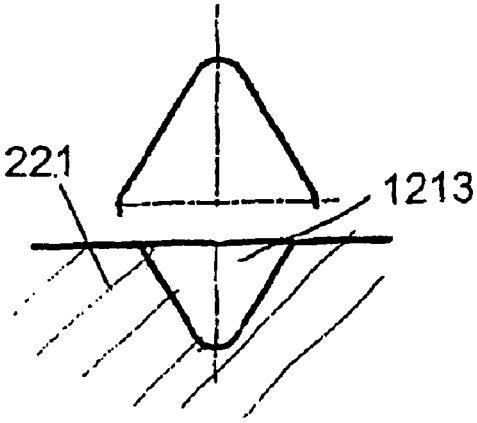
Figure 8F:
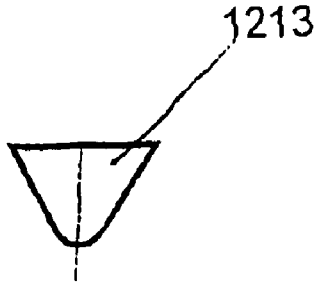

FIG. 7*c* shows a cross-section through the helical element engaged in a carrier groove;

FIG. 7*d* shows a cross-section through a cutting portion of the helical element;

FIG. 7*e* shows an isometric view of a cutter assembly according to an embodiment of the present invention;

FIGS. 8*a* and 8*b* show the final step of grinding the outer periphery of the diamond cross-section helical element according to a second embodiment of the present invention;

FIGS. 8*c* and 8*d* show the method of grinding down the helical cutting element to form a triangle as described above with regard to the first embodiment of the invention; and FIGS. 8*e* and 8*f* show a method of grinding down the helical element according to a third embodiment of the present invention.

FIG. 1 shows a first cutter assembly for a dry shaver as known from U.S. Pat. No. 6,560,875. This assembly is intended to be oscillated along the axis A-A, and is provided with a plurality of arcuate cutter elements 101. Thus the arcuate cutter elements 101 are arranged parallel to one another spaced along the length of the carrier 201. Gaps are provided between every adjacent pair of cutters, into which gaps hairs may protrude during use, so that by means of the oscillatory motion of the carrier 201 and thereby the cutter elements 101, the hairs may be cut. There may further be provided a foil screen (not shown) between the skin of the user, and the cutters 101 having holes sufficiently large to allow hairs to pass, for cutting by the cutters 101, whilst protecting the skin of the user.

The assembly of FIG. 1 is machined from a single block of metal, which leads to a high manufacturing cost. Furthermore, the cutting angle of each cutter element 101 cannot easily be varied from 90°, without a still further increase in the manufacturing costs, such that effective cutting is difficult to achieve.

FIG. 2*a* shows a cutting assembly for a dry shaver as known from U.S. Pat. No. 2,281,250 (Ruskin). In this arrangement, there is provided a cylindrical carrier 211, on the outer surface of which is provided a helical thread 212, protruding from the surface of the carrier 211. In this apparatus, there is further provided a helical cutting strip 111, which is wound about the carrier 211, so as to rest upon the thread 212, so that the helices of the thread and the cutting strip are aligned with each other. The cutting thread 111 is provided with an acute cutting edge 112, so as to offer improved cutting performance.

The cutting strip is secured to the thread 212 by pins 214.

FIG. 2*b* shows a development of the assembly of FIG. 2*a*, in which the cutting strip 111 is triangular in cross-section, so as to provide a first cutting edge 112, and a second cutting edge 113. As shown in this Figure, the helical thread 212 is provided with a helical indentation 213, to receive the apex of the triangular cutting strip 111.

Thus in use, the device of FIGS. 2*a* and 2*b* is oscillated back and forth along the axis B-B, so that the cutting edge or edges of the cutting strip 111 engages hairs introduced into the gap between separate loops of the cutting strip 111. This arrangement thus achieves cutting performance superior to that of the arrangement shown in FIG. 2*a*, due to the sharpened cutting edge which can be formed on the cutting strip 111. This arrangement does however entail considerable expense in its manufacture, due to the difficulty of producing a helical cutting strip, and satisfactorily fixing this to the thread 212. It is in particular to be noted that a linear cutting strip cannot be wound onto the helical thread, without distortion occurring.

The present disclosure relates to a cutter assembly for a shaver where a helical cutter element is secured to a carrier member in such a way that portions of the helical turns of the cutter element form a plurality of free-span arches having exposed cutting edges. By analogy with bridge construction, the term free-span arch is here used to indicate that the arch is supported only at its ends and is otherwise self-supporting, and out of contact with the carrier member.

The helical cutter element thus has a plurality of turns, of which some are provided with cutting portions and forming free-span arches. Generally the greater part of the turns will be provided with cutting portions forming free span arches.

The carrier member may engage some or all of the turns of the helical cutter element, so that some turns may be entirely unsupported. Some turns on the other hand may engage the carrier member about their entire circumference, so that such turns comprise spans which are not free in the sense described above. Each turn may be provided with a cutting edge, whatever part of it is supported by the carrier member.

The shaver is preferably a dry shaver, and is preferably of the motor driven variety. The carrier member may be within the helix of the helical cutter element, or outside the helix, or have portions both inside and outside the helix. The carrier member may have threads to engage the helical cutter element, or raised portions, or the cutter member may be embedded in the carrier member, which may be formed of a resin or other such mouldable material.

The present invention comprises both the cutter itself, and methods for making such a device.

According to one example of a method according to the invention, the process begins with a simple cylindrical blank, of whatever material is selected for the support element or carrier member 221, as discussed below. The carrier member is preferably disposed within the helical element, and preferably has a substantially "c" shaped or "u" shaped cross section. The cutting portions preferably each provide a pair of opposed acute-angled cutting edges. The material of which the helical element is constituted may have a triangular cross section, and the apex of this triangular cross section of the helical element may be on the inside of the helix.

The carrier member 221 is preferably provided with grooves to receive the mounting portions of said helical element.

FIG. 3*a* shows the first and second steps of the method of manufacture according to one embodiment of the invention in a side an cross sectional view. In the first step, a helical thread 222 is machined into the carrier member 221, using any of the machining techniques that will readily occur to the skilled person.

FIG. 3*b* shows a section of E-E of the support member shown in FIG. 3*a*. The cross sectional view shows a cross section through the line E-E.

FIG. 3*c* shows a partial cross-section of the carrier member as formed by this threading process.

FIG. 4*a* shows the second and third steps of the method according to this embodiment of the present invention. According to this method, a cavity is drilled or otherwise formed through the axis of the support element. One side of the cylinder forming the carrier member is then machined flat, so as to produce a flat surface 223. The diameter of the cavity drilled through the axis of the carrier member, and the depth of the flat machined on the side of the cylinder are selected so that a portion of the wall of the carrier member 221 is removed over a part of its circumference. Preferably, the wall of the cylinder should be removed over approximately 100° of the circumference. Thus when one side of the cylinder is machined through so far as to intersect the cavity through the support component, the flat is replaced with two coplanar surfaces separated by the hole.

FIG. 4*b* shows a section F-F of the support member shown in FIG. 4*a*. In particular, it is clear from this figure how the method described with respect to FIG. 4*a* forms a hollow 224.

FIG. 5*a* shows a helical structure used as a component of the cutting assembly according to an embodiment of the present invention. The helical structure according to this embodiment has a substantially diamond shaped cross-section as shown in FIG. 5*b*. The helical structure 1210 may for example comprise a thread insert, of the kind readily commercially available.

This helical element should be formed preferably of a material resistant to corrosion, able to carry a sharp edge, and to be resistant to wear. Still further, the material should preferably be hardenable by heat treatment, and suited to grinding as a means of changing the cross-section or shape thereof. Most preferably, the helical element 1210 should be formed of a heat treatable high carbon alloy steel, such as a heat treatable carbon stainless steel. Most preferably, the helical element 1210 should be formed of a steel conforming to the standard EX 46 CR 13, Stavax, EX 39 CR MO 17, or 460, or an equivalent standard steel, as will readily occur to the skilled person.

FIG. 6*a* shows a fourth step in the method according to this embodiment of the present invention. In this fourth step, the helical element 1210 is wound or screwed onto a corresponding thread, machined into the surface of the cylindrical support element 221 as described above with regard to FIG. 3*a*. The helical element 1210 is at this point preferably fixed to the carrier member 221, preferably by means of a spot weld or a laser weld, or other appropriate method as will readily occur to the skilled person. In particular, it may be appropriate to use pins to secure the helical element 1210 to the carrier member 221. The counter assembly as shown in FIG. 6*a* now comprises a helical element 1210 threaded onto a substantially cylindrical carrier 221 and welded or otherwise fixed thereto. The carrier member 221 is hollow, having a central cavity 224, and further has a flat area 223, such that a part of the circumference of the helical element 1210 is out of contact with the carrier 221, and forms an unsupported arcuate cutting member 225. Other parts of the helical element are supported by or other wise in contact with the carrier 221, so as to form mounting portions.

FIG. 6*b* shows a section G-G through the carrier member and helical element shown in FIG. 6*a*, and in particular shows the corresponding helical thread 222 and form mounting portions 226 described with respect to FIG. 6*a*.

FIG. 6*c* shows a cross-section of the helical element 1210, when threaded into position on the carrier 221.

FIG. 6*d* shows an isometric projection of the assembly shown in FIG. 6*a*.

FIG. 7*a* shows the cutter assembly after the execution of a fifth step according to this embodiment of the present invention. In this step, the outer periphery of the assembly is ground down, so that the protruding vertex of the helical element 1210 as shown in FIGS. 6*a*, 6*b* and 6*c*, is ground to a flat, over its whole circumference.

FIG. 7*b* shows a section H-H through the carrier member and helical elements shown in FIG. 7*a;*

According to this embodiment, the outer vertex of the helical element 1210 is ground down to the widest parts of the helical element having a diamond cross-section, so that the remaining cross-section is essentially a triangle, as shown in FIGS. 7*c* and 7*d*. The result is a helical cutting element 1211, having acute-angled cutting edges 1211*a* and 1211*b*.

FIG. 7*e* shows a cutter assembly according to an embodiment of the present invention. According to this embodiment, there is provided a carrier member 221, and a helical cutting element 1211. The carrier member 221 is disposed within the helical cutting element 1211, so as to support the helical cutting element 1211 throughout at least a part of its circumference, at least one point along its length. According to the embodiment of the invention shown in FIG. 7*d*, the carrier member 221 in fact has the shape of a partial cylinder on one side of which a flat is provided, so that the hollow cavity within is exposed, bisecting the flat so that it forms two coplanar surfaces. This cylinder is further provided with a coaxial helical thread, to receive the helical cutting element 1211. The helical cutting element 1211 is of triangular cross-section, as shown more clearly in FIG. 7*c*. The helical cutting element 1211 is supported with sufficient rigidity, that when the cutter assembly is oscillated along the axis D-D, and the unsupported arches of the helical cutting element 1211 are applied to the hair to be cut, the hairs will be introduced into the gaps between the individual arcuate cutting portions 225 of the helical cutting element 1211, and cut thereby as the element oscillates.

A variety of means of coupling the assembly to means of activation such as an electric motor will readily occur to the skilled person. For example, holes or slots may be machined into the carrier element 221 for engagement with a coupling member to impart the oscillatory motion described above under the power of that activation means.

A further element may be provided between the skin of the user and the assembly, for example in the form of a mesh or grille, having holes large enough to allow the ingress of hairs, but preventing the exposure of the user's skin to the cutting element 1211, as will readily occur to the skilled person.

The form of the carrier member 221 may be varied substantially both in terms of its cross-section, and along its length, so as to arrive at an optimum compromise between weight, materials used, production costs, mechanical strength etc., as will readily occur to the skilled person. Similarly, the cross-sectional shape of the helical cutting element, as well as its pitch and other physical properties may be selected so as to offer optimum performance in terms of cutting performance, blade lifetime, comfort etc., as will readily occur to the skilled person.

The material selected for the carrier member 221 may comprise any of a number of metals, plastics, composite materials etc. as will readily occur to the skilled person. Similarly, the material for the helical cutting element 1211 may be selected so as to give the best possible performance in terms of cutting performance, comfort, durability and cost, etc. as will readily occur to the skilled person.

Preferably, the helical cutting element 1211 should comprise a heat treatable high carbon or high alloy steel. Ideally, this should be a heat treatable carbon stainless steel. Still more preferably, this should be a steel conforming to the EX 46 CR 13, Stavax, EX 39 CR MO 17, or Stainless Steel 460 standards. The helical element 1211 may for example be derived from a thread insert, of the kind readily commercially available. According to this embodiment of the present invention, the arches of the helical cutting element 1211 are unsupported over approximately 100° of the helical circumference, and may be secured to the support element 221 by any of the means that may readily occur to the skilled person, for example spot welding, laser welding etc.

According to this embodiment, there is therefore provided a cutter for a shaver, comprising an elongate carrier member, and a helical element having a plurality of turns, each providing an arcuate cutting portion and an arcuate mounting portion following sequentially in the circumferential direction. This carrier member is disposed substantially parallel to the axis of the helical element, to engage and support the mounting portions of the turns and leave the cutting portions as unsupported arches. This configuration offers the advantages that the cutting edges are exposed, and are thus easily cleaned, and offers little resistance to hair insertion. The assembly is thus highly suited to use in the presence of a lubricant.

The assembly according to this embodiment is highly suited to mass production, and indeed can be assembled at least partially from standard, off-the-shelf components. The assembly thus offers a low cost of manufacture.

FIGS. 8*a* and 8*b* show the final step of grinding the outer periphery of the diamond cross-section helical element 1210 according to a second embodiment of the present invention. According to this embodiment, the helical element is not ground all the way down to its widest part so as to form a triangular cross-section but rather ground to a lesser extent, so that the eventual cross-section of the helical element is a truncated lozenge shape 1212 as shown in FIGS. 8*a* and 8*b*. Having a cutting element of this cross-sectional shape may be found to be advantageous in the final shaving device, as it will lead to hairs being cut at a predetermined distance from the skin surface, so that damage to the skin itself is reduced, thereby leading to a subjectively more comfortable shave.

FIGS. 8*c* and 8*d* show the method of grinding down the helical cutting element 1210 to form a triangle as described above with regard to the first embodiment of the invention, and FIGS. 3*a* to 7*d* inclusive.

Thus according to this embodiment of the present invention there is provided a method of producing a cutter for a shaver, comprising the steps of machining a flat on one side of a cylinder to produce a reduced cross-sectional thickness, and securing a helical element around said cylinder, to provide a plurality of arcuate cutting members in the form of unsupported arches spanning over the flat region.

Optionally, a cavity of a first radius axially of the cylinder having a second radius may be drilled, so that the reduced cross-sectional thickness lies between said second radius, and said second radius plus said first radius. A helical thread may be machined into the outer wall of the cylinder for receiving said helical cutting element. The helical element may initially have a rhombic cross-section, which may then be reduced to a triangular cross-section by machining. The helical element may have a cross section such that by machining an external surface thereof a sharp edge can be formed on at least one edge thereof, fixing said helical element around a cylinder, and machining an external surface of said helical element so as to form a sharp edge on at least one edge thereof.

A cavity of a first radius may be drilled axially of the cylinder of second radius, and a flat machined on one side of the cylinder, so that the cross-sectional thickness of the cylinder lies between said second radius and said second radius plus said first radius. By machining an external surface of said helical element, sharp edges may be produced on both helical edges thereof. Prior to the step of fixing a helical element around the cylinder, a helical thread may be machined into it, of such dimensions as to receive the helical element.

FIGS. 8*e* and 8*f* show a method of grinding down the helical element 1210 according to a third embodiment of the present invention, according to which the diamond cross-sectioned helical element is ground down beyond its widest point, so as to arrive at a smaller cross-sectional area 1213 than that arrived at by the method described above with regard to FIGS. 3*a* to 7*d*. This may be advantageous in terms of optimising the geometry, and physical properties of the final cutting element.

According to a still further embodiment of the present invention, the helical element 1210 may be extruded or otherwise formed as a wire having any desired cross-sectional geometry, and then wound into a helical element, prior to the steps as described with regard to FIG. 6*a* onwards. This approach will again offer a greater degree of choice as regards the geometry, physical properties and materials present in the final cutting assembly.

As a still further embodiment of the present invention, rather than forming the carrier member 221, by the steps described above with regard to FIGS. 3*a* to 7*d*, the carrier member may be formed by other means that may occur to the skilled person, for example by a moulding process, extrusion, etc. Where a moulding process is adopted, it may be desirable to mould the carrier member 221 directly onto the helical element 1210, prior to or after the step of grinding described above with regard to FIG. 7*a* to 7*d*.

Although as described above the carrier member engages each turn of the helical element, the skilled person will recognise that it is in fact only necessary to support a sufficient number of the turns so that the helix is maintained substantially rigidly in use.

There is thus provided a cutter for a dry shaver, comprising: an elongate carrier member; a helical element having a plurality of turns, each having an arcuate cutting portion and an arcuate mounting portion following sequentially in the circumferential direction; said carrier member being disposed substantially parallel to the axis of said helical element; and said carrier member engaging and supporting the mounting portions of the turns and leaving the cutting portions as unsupported arches.

Alternatively there is provided a cutter for a shaver, comprising an elongate carrier member, and a helical element having a plurality of turns, each having an arcuate cutting portion and an arcuate mounting portion. This carrier member is disposed substantially parallel to the axis of the helical element, whilst engaging and supporting the mounting portions of the turns and leaving the cutting portions unsupported.

There is thus furthermore provided a method of producing a cutter for a dry shaver, comprising the steps of providing an elongate carrier member having a first cross-sectional thickness in a first direction and a second smaller cross-sectional thickness in a second direction perpendicular to the first direction; and securing a helical element around said carrier member, where portions of said helical element form a plurality of unsupported arches having exposed cutting edges.

There follows a list of the structural elements discussed above, and their corresponding reference numbers.

101 Prior art arcuate cutter elements.
111 Prior art helical cutting strip.
112 Prior art acute cutting edge.
113 Prior art second cutting edge.
201 A prior art Carrier.
211 A prior art Cylindrical carrier.
212 A prior art Helical thread.
213 A prior art Helical indentation.
214 A prior art Pin.
221 Carrier member.
222 Helical thread.
223 Flat area.
224 Central cavity.
225 Arcuate cutting portion
226 Mounting portion
1210 Helical structure
1211 Helical cutting element,
1211*a* and 1211*b* Acute-angled cutting edges.
1212 Truncated lozenge cross-sectioned helical cutting element.
1213 Small cross sectional area helical cutting element.

The invention claimed is:

1. A cutter assembly for a dry shaver, comprising:
an elongate carrier member (221) having a substantially "c" or "u" shaped cross section; and
a cutter element (1210) having a plurality of turns forming a helix, each having an arcuate cutting portion (225) and an arcuate mounting portion (226) following sequentially along the helix;
said carrier member (221) being disposed substantially parallel to the axis of said cutter element; and
said carrier member (221) contacting and supporting the mounting portions (226) of the turns and leaving the cutting portions (225) as free-span arches.

2. An assembly according to claim 1, wherein said carrier member (221) is disposed within said cutter element (1210).

3. An assembly according to claim 1, wherein said cutting portions (225) each provide a pair of opposed acute-angled cutting edges (1211*a*, 1211*b*).

4. An assembly according to claim 3, wherein the turns of the cutter element (1210) are triangular in cross-section.

5. An assembly according to claim 4, wherein the apex of said triangular cross section of the cutter element (1210) is on the inside of the helix formed thereby.

6. An assembly according to claim 1, wherein said carrier member (221) is provided with a thread (222) to receive the mounting portions of said cutter element (1210).

7. A method of producing a cutter assembly for a dry shaver, comprising the steps of:
producing an elongate carrier member (221) having a substantially "c" or "u" shaped cross section;
producing a cutter element (1210) having a plurality of turns forming a helix, each having an arcuate cutting portion (225) and an arcuate mounting portion (226) following sequentially along the helix; and
securing the mounting portions of each of said plurality of turns to said carrier member (221) so that the carrier member (221) contacts and supports the mounting portions (225) of the turns and leaves the cutting portions (225) as free-span arches.

8. A method according to claim 7 in which said carrier member (221) is formed by removing material from one side of a circular-cylindrical body.

9. A method according to claim 8 in which a flat (223) is machined on one side of said body.

10. The method of claim 9 further comprising:
the further step of drilling a cavity (224) of a first radius axially of the body (221) having a second radius; and
wherein in machining said flat the cross-sectional thickness of said body perpendicular said flat is reduced by an amount greater than the difference between said first radius and said second radius.

11. The method of claim 9 comprising the further step of:
machining a helical thread (222) into the surface of said body for receiving said helical cutter element.

12. The method of claim 7, wherein said helical cutter element (1210) initially has a rhombic cross-section and is reduced to a triangular cross-section by machining.

13. A method of producing a cutter for a dry shaver comprising the steps of:
providing a helical element (1210) having a cross section such that by machining an external surface thereof a sharp edge is formed on at least one edge thereof;
fixing said helical element around an elongate support (221) having a substantially "c" or "u" shaped cross section that contacts and supports mounting portions (225) of the helical element 1210 and leaves cutting portions (225) of the helical element as free-span arches; and removing said external surface of said helical element (1210) so as to form said sharp edge on at least one edge thereof.

14. A method according to claim 13 in which said helical element is fixed around a cylindrical body (221).

15. The method according to claim 14 comprising the further steps of:

forming a cavity (224) of a first radius axially of the cylindrical body of second radius; and forming a flat on one side of said cylindrical body (223), so that the cross-sectional thickness of the cylindrical body (221) perpendicular said flat is reduced by an amount greater than the difference between said first radius and said second radius.

16. The method of claim 14 comprising the further step of:

prior to said step of fixing a helical element (1210) around said cylindrical body, forming a helical thread (222) into said body (221), of such dimensions as to receive said helical element (1210).

17. The method of claim 13, wherein at said step of removing an external surface of said helical element (1210), sharp edges are produced on both helical edges thereof.

18. A method of producing a cutter for a dry shaver, comprising the steps of;

providing a helical element (1210) having an inner diameter having a first dimension;

forming arcuate cutting portions on successive turns of said helical element;

providing an elongate carrier member (221) having a substantially "c" or "u" shaped cross section, said carrier member (221) having a thickness, as seen in a direction transverse to its longitudinal extent, of a second dimension, said second dimension being less than said first dimension of the helical element;

contacting the helical element with the carrier member (221); and extending the arcuate cutting portions as free-span arches above and transversely across the carrier member in spaced relation.

* * * * *